United States Patent [19]

Downs

[11] Patent Number: 4,739,152

[45] Date of Patent: Apr. 19, 1988

[54] ELECTRIC RADIANT HEATING DEVICE FOR LOCALIZED HEATING OF OBJECTS AND SUBSTANCES

[76] Inventor: James W. Downs, 3846 Dunford Way, Santa Clara, Calif. 95051

[21] Appl. No.: 782,031

[22] Filed: Sep. 30, 1985

[51] Int. Cl.[4] ..... H05B 1/00

[52] U.S. Cl. ..... 219/347; 219/349; 219/354; 219/358; 219/461; 313/113; 313/114; 362/298

[58] Field of Search ..... 219/339, 342, 343, 346, 219/347–349, 358, 461; 313/113, 114; 362/298

[56] References Cited

U.S. PATENT DOCUMENTS

| | | | |
|---|---|---|---|
| 2,059,033 | 10/1936 | Rivier | 313/114 X |
| 2,512,061 | 6/1950 | Huck | 219/347 X |
| 2,785,623 | 3/1957 | Graham | 219/349 X |
| 3,253,504 | 5/1966 | Vollmer | 313/114 |
| 3,401,256 | 9/1968 | Siegla | 219/354 X |
| 3,427,433 | 2/1969 | Foreman et al. | 219/354 X |
| 3,427,435 | 2/1969 | Webb | 219/349 X |
| 3,434,818 | 3/1969 | Chauvin | 219/349 X |
| 3,621,198 | 11/1971 | Herbrich | 219/349 |

FOREIGN PATENT DOCUMENTS

| | | | |
|---|---|---|---|
| 502262 | 7/1930 | Fed. Rep. of Germany | 219/349 |
| 2506494 | 8/1976 | Fed. Rep. of Germany | 219/347 |
| 762484 | 1/1934 | France | 362/298 |
| 1089131 | 9/1954 | France | 219/347 |
| 359778 | 6/1938 | Italy | 362/298 |
| 532914 | 2/1941 | United Kingdom | 219/347 |
| 727346 | 3/1955 | United Kingdom | 219/349 |

OTHER PUBLICATIONS

"Radiant Heating Using an Ellipsoidal Reflector"; B. Uavala, A. Muries; Journal of Physics E, vol. 7, No. 5, pp. 349–350; May 1974.

*Primary Examiner*—Anthony Bartis
*Attorney, Agent, or Firm*—Warren H. Kintzinger

[57] ABSTRACT

An elongated, coiled, electrical resistance heating filament is positioned along the major axis of an ellipsoidal reflector with its inner end positioned at the inner focus of the reflector and with the coil extending outwardly toward but short of an annular rim defining the front of the reflector. The coiled filament is supported by a pair of power supply leads connected to the inner and outer ends of thereof and forming stiff conductive support pillars mounted in a thickened support and seal portion at the apex of the reflector. The front of the reflector may be closed by a glass plate sealed to the annular rim. A secondary reflector may be provided on the major axis of the ellipsoidal reflector between the outer end of the coiled filament and the annular rim. The secondary reflector may be a figure of rotation of any shape, e.g., parabolic or conical, capable of throwing energy that would otherwise escape back through the coiled filament and serves to conserve energy and shield the eyes of the user.

11 Claims, 2 Drawing Sheets

ELECTRIC RADIANT HEATING DEVICE FOR LOCALIZED HEATING OF OBJECTS AND SUBSTANCES

Figure 1:
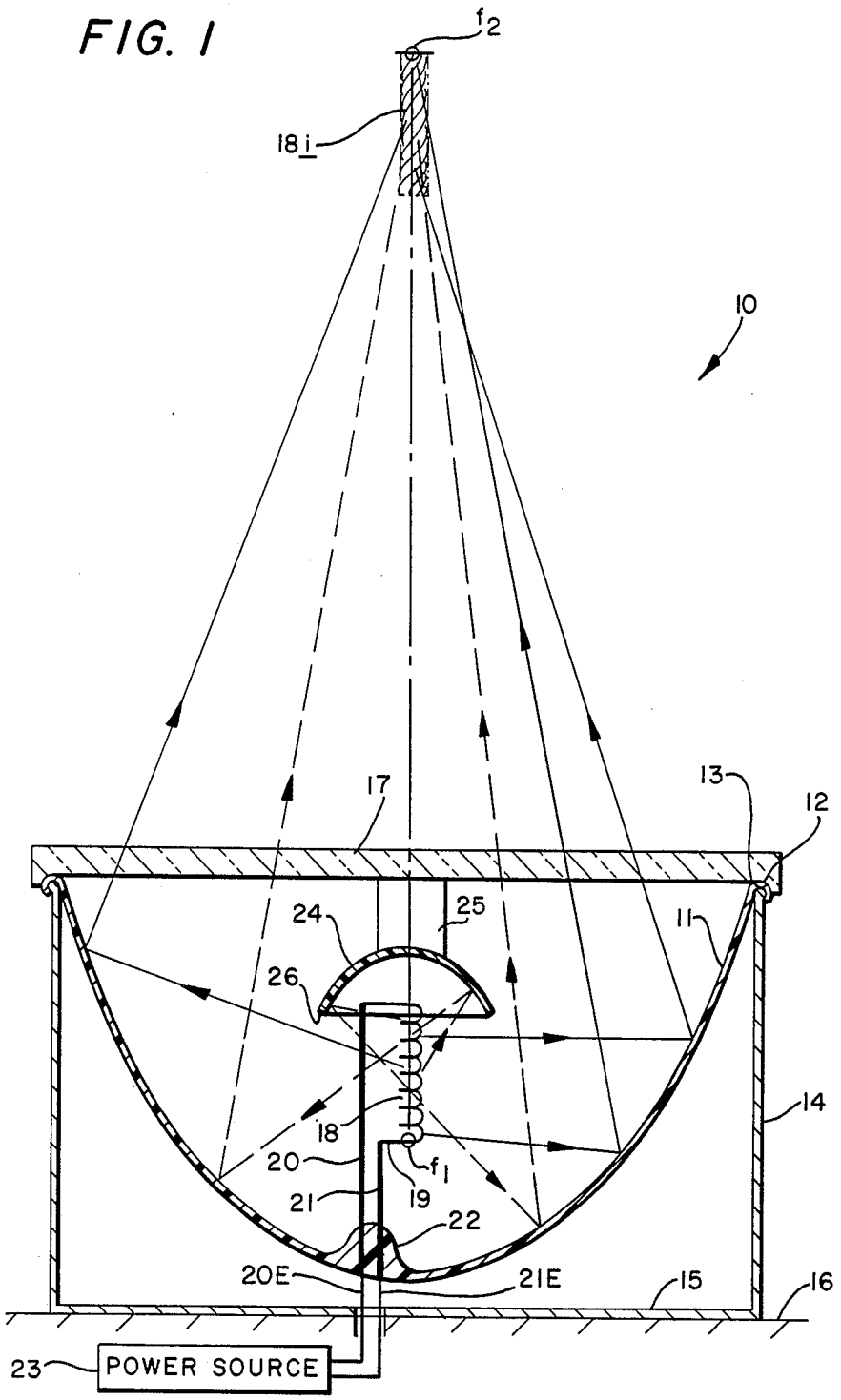

This invention relates in general to heating devices such as Bunsen burners, and more particularly, to an electric power driven Bunsen burner that projects a hot image of a heated filament located on the major axis of a shaped reflector with one end of the filament at the inner focus and extending away from the vertex of the reflector.

Conventional gas fueled Bunsen burners while excellent for many heating applications still have many limitations. They simply can not be used in areas not supplied with gas without portable gas supplies. Bunsen burners can not be used where open flames are not permitted by fire codes. Further, combustion products from a gas Bunsen burner can contaminate not only the environment in a room but also substances being heated and the products of research projects. Further, it is important to be able to concentrate heat where needed rather than heating a lot of air in addition to the article or substance to be heated. With some burners and heaters light is emitted that shines into the eyes of the operator.

It is therefore a principal object of this invention to provide an electric Bunsen burner that projects an image of a heated filament to a desired external location.

Another object is to provide localized heating of objects and/or substances without products of combustion being present.

A further object is to be able to provide localized heating of an object within a bell jar from a heated filament source outside the bell jar.

Still another object is to provide a heating device that does not employ an open flame.

Another object is to provide an electric Bunsen burner that is useable in areas not supplied with gas.

Features of the invention useful in accomplishing the above objects include, in an electric Bunsen burner, a heat producing filament, positioned on the major axis of an ellipsoid reflector, that has one end at the inner focus and extends outward away from the vertex of the reflector such that an inverted image of the filament is projected to the outer focus of the reflector. Some units include a glass front that may be part of a glass envelope with the filament behind the glass front and the inverted image of the filament outside the glass envelope. Electric power is supplied to the filament subject to control by a solid state dimmer or a variable transformer. A secondary reflector is provided on the major axis of the primary ellipsoid reflector in some embodiments with the secondary reflector actually nearly any shape (ellipse, parabola, hyperbola, or shallow cone) as long as they are figures of rotation and would throw the energy back through the coiled filament. This secondary reflector conserves some of the energy that would otherwise escape and also acts as a shield keeping light out of the eyes of the operator.

Specific embodiments representing what are presently regarding as the best modes of carrying out the invention are illustrated in the accompanying drawings.

Figure 2:
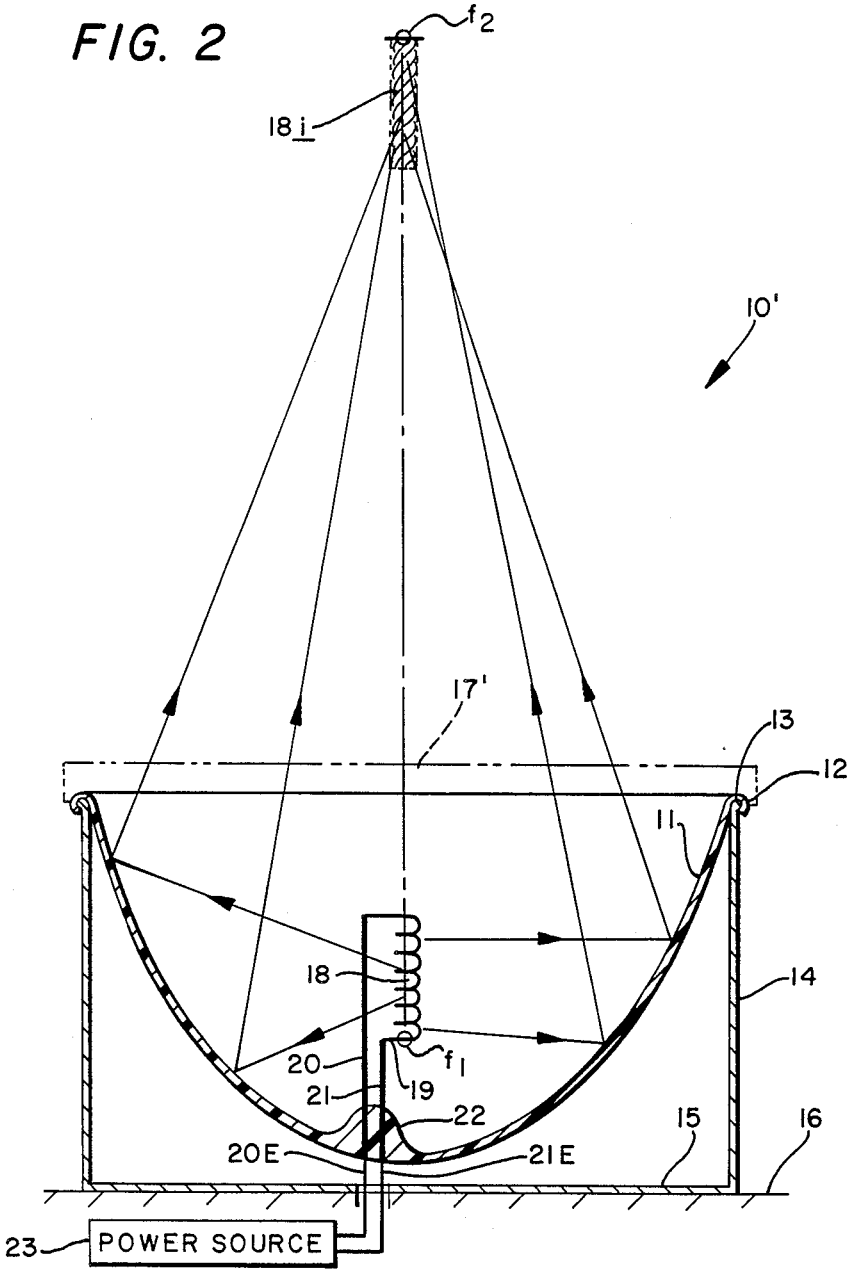

In the drawings:

FIG. 1 represents a diagramatic partially cut away and sectioned view of an electric Bunsen burner with a primary ellipsoid reflector and a heat producing elongate filament positioned on and extending along the major axis of the primary reflector extending outwardly away from the inner focus and a secondary reflector on the major axis of the primary reflector; and FIG. 2, a diagramatic cut away and sectioned side elevation view of an electric Bunsen burner without a secondary reflector.

Referring to the drawings:

The electric Bunsen burner 10 of FIG. 1 is shown to include a primary ellipsoidal reflector 11 that has an inner focus $f_1$ and an outer focus $f_2$ both positioned on the major axis of the ellipsoid reflector 11. The primary ellipsoid reflector 11 has a annular rolled edge 12 supported on the top annular rim 13 of cylindrical container wall 14 extended upwardly from a bottom 15 suited to be a base mountable on a support surface 16. A glass face 17 or wall is sealed to reflector annular rolled edge 12 in a conventional manner so as to enclose the ellipsoid reflector 11 with a transparent face. An elongate coiled filament 18 is mounted within the ellipsoid reflector 11 with its bottom 19 at the inner focus $f_1$ and extending upwardly along the major axis to its upper end 20. Please note that while the filament 18 is shown to be a coiled filament it could be a bar filament with one end at the inner focus $f_1$ and extending for a length outwardly substantially on the major axis of the ellipsoid reflector 11. Please note further that the coiled filament or any filament so employed be of relatively small transverse extent so as to in effect concentrate heat generated thereby with electric current flow through the filament 18 to substantially a bar image heat source extended for a discreet distance distance along the major axis of the ellipsoid reflector 11 from $f_1$ outward. Wire leads 20 and 21 that extend through thickened seal and support 22 at the bottom of primary ellipsoid reflector 11 are, in addition to conducting electrical power to the filament 18 in being connected to oposite ends thereof, relatively stiff and strong enough to mount the filament 18 from the thickened seal and support 22 of the reflector 11. Extensions 20E and 21E from wire leads 20 and 21 extend outward through bottom 15 or wall 14 to an electrical power source 23 that in addition to a power plug or a generator includes a solid state dimmer or a variable transformer, detail not shown, for control of electrical power in the range of up to two hundred watts or more to the filament 18.

With production in large quantity, a molded glass envelope, similar to sealed beam headlights in cars, could be used. A spun aluminum reflector is also quite practical and can be made to use a commercially available Ql projector lamp as long as the filament thereof is positioned and oriented relative to the primary ellipsoid reflector in accord with the teachings hereof. Production models in a glass envelope could be made as an integral unit with interior of the bottom part of the glass envelope as the ellipsoid reflector with a suitable connector at the bottom. In any event with the filament 18 so positioned on the major axis of the ellipsoid reflector 11 extending outwardly from $f_1$ a heated inverted image **18*i* is projected to extend inwardly from the outer focus $f_2$ as shown in FIG. 1. This is with electromagnetic energy heat radiation being reflected from the elliposid reflector 11 through glass face 17 and on through any other transparent media such as a transparent bell jar wall. In order to effectively heat an object or substance to be heated it should be positioned or the electric Bunsen burner 10 so positioned as to have the object or substance, that must be opaque to intercept the radiated energy, in the image 18*i*** loction. An extended filament 18 extended along the major axis of an ellipsoid reflector 11 in the manner set forth is very much more effective in concentrating radiated heat in the projected image 18*i* than would projected radiation results obtained with other filament shapes and orientations. A filament extended transversely to the major axis would not yield the electric Bunsen burner results such as provided with applicant's teachings. A prototype unit has been built using a two hundred fifty watt quartz-iodine projector lamp and a small ellipsoid reflector and even with reduced power there was no problem in igniting a piece of paper positioned in the projected image 18*i*.

A small secondary concave reflector 24 may be provided that can be mounted such as by pillar 25 that is fused, or glued, to be both the inner face of front face wall 17 and the back top curved surface of secondary reflector 24. This serves at least two purposes in that it will conserve some of the radiated energy that would otherwise escape and provide a shield to keep light out of the eyes of the operator. The small concave secondary reflector 24 is so positioned and shaped as to direct some of the radiated energy down through the area of filament 18 and on to the reflective surface of the ellipsoidal reflector 11. Further, the small concave secondary reflector 24 may assume nearly any shape (ellipse, parabola, hyperbola, or shallow cone) as long as they are figures of rotation and would throw the energy back through the area of the filament 18. It should be noted that the transverse extent of pillar 25 be substantially less than the transverse extent of the small secondary concave reflector 24 so as to not impede the passage of any radiation reflected from reflector 11 that passes by the outer rim 26 of reflector 24 from transmission on through glass wall 17.

Referring now to the electric Bunsen burner 10' embodiment of FIG. 2 many of the components and features are the same and are numbered the same and in some instances with primed numbers as a matter of convenience. With this embodiment a secondary reflector and mounting pillar therefore are not included. Further, the glass face 17' is indicated in phantom as it will be included with some units and not with others. With the embodiment of FIG. 1 if alternate means were provided for mounting the secondary reflector 24 units thereof could be provided with the glass face wall 17 and pillar 25 omitted.

The electric Bunsen burner 10 and 10' and other variations thereof can be used in most any orientation, they may be held with the image 18*i* projected horizontally or even mounted upside down to project the image 18*i* downward beneath the burner. Gas fueled Bunsen burners are more generally limited to upright use. If the projected radiated energy does not impinge on the object or material of an opaque nature the radiated energy will pass through the concentrated image area to disperse in the background therebeyond.

Whereas this invention has been described with respect to several embodiments thereof it should be realized that various changes may be made without departure from the essential contributions to the art made by the teachings hereof.

I claim:

1. An electric burner comprising: an ellipsoidal reflector having an inner focus and an outer focus with both focus points on the major axis of the ellipsoidal reflector; an elongate filament mounted within the ellipsoidal reflector with an inner end substantially at the inner focus point and extending outwardly along the major axis of the ellipsoidal reflector; support means mounting said elongate filament in said ellipsoidal reflector; and power supply connective means connected to said elongate filament for the feeding of electric power to and through said elongate filament; wherein said ellipsoidal reflector terminates in an annular rim; and said elongate filament is short enough that the outer end of said filament is in said ellipsoidal reflector within and spaced from the plane of said annular rim; said elongate filament is a filament coil long along its axis relative to its transverse thickness with its inner end and outer end mounted from said ellipsoidal reflector so that the coil's axis is substantially coexistent through the length of said filament coil with said major axis of the ellipsoidal reflector such that an inverted image of the filament is projected to extend inwardly along said major axis from said outer focus point; and wherein said filament coil has two support leads connected to the inner coil end and outer coil end with stiff conductive pillars mounted in a thickened support of said ellipsoidal reflector adjacent the apex thereof as the mounting support of said filament coil; and two leads connected to said two support leads connectable to a power supply as said power supply connective means.

2. The electric burner of claim 1, wherein a secondary reflector is mounted on the major axis of said ellipsoidal reflector that is a figure of rotation shaped and positioned to throw radiated energy back through the coiled filament.

3. The electric burner of claim 2, wherein said secondary reflector is shaped and positioned to also be a shield keeping directly radiated light out of the eyes of the operator.

4. The electric burner of claim 1, wherein a transparent glass wall is sealed to said annular rim to form a sealed chamber with said ellipsoidal reflector with said elongate filament coil being contained within said sealed chamber.

5. The electric burner of claim 4, wherein a secondary reflector is mounted on the major axis of said ellipsoidal reflector that is a figure of rotation shaped and positioned to throw radiated energy back through the coiled filament and with said secondary reflector being contained within said sealed chamber.

6. The electric burner of claim 5, wherein said secondary reflector is shaped and positioned to also be a shield keeping directly radiated light out of the eyes of the operator.

7. The electric burner of claim 6, wherein said secondary reflector is mounted from the interior face of said transparent glass wall.

8. The electric burner of claim 7, wherein said secondary reflector is inverted relative to the orientation of said ellipsoidal reflector.

9. The electric burner of claim 8, wherein said secondary reflector is mounted from the interior face of said transparent glass wall by pillar means connected to the glass wall and to the back of said secondary reflector.

10. The electric burner of claim 9, wherein said secondary reflector terminates in an annular rim.

11. The electric burner of claim 10, wherein the transverse extent of said pillar means is substantially less than the transverse extent across the annular rim of said secondary reflector.

* * * * *